US006537399B2

(12) United States Patent
Gomez De Segura et al.

(10) Patent No.: US 6,537,399 B2
(45) **Date of Patent: *Mar. 25, 2003**

(54) PROCESS AND MECHANISM FOR IN SITU SENSITIZATION OF AQUEOUS EXPLOSIVES

(75) Inventors: Fernando Beitia Gomez De Segura, Murguia (ES); Jose Ramon Quintana Angulo, Getxo (ES); Rafael Lanza Rivas, Las Arenas (ES)

(73) Assignee: Union Espanola de Explosivos, S.A. (ES)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 109 days.

(21) Appl. No.: 09/446,724

(22) PCT Filed: Nov. 26, 1997

(86) PCT No.: PCT/ES97/00291

§ 371 (c)(1),
(2), (4) Date: Mar. 13, 2000

(87) PCT Pub. No.: WO99/00342

PCT Pub. Date: Jan. 7, 1999

(65) Prior Publication Data

US 2002/0124918 A1 Sep. 12, 2002

(30) Foreign Application Priority Data

Jun. 26, 1997 (ES) ..... 9701411

(51) Int. Cl.[7] ..... D03D 23/00; F42D 3/00

(52) U.S. Cl. ..... 149/109.6; 102/313

(58) Field of Search ..... 102/313, 289; 86/20.15; 146/60, 108.8, 109.6

(56) References Cited

U.S. PATENT DOCUMENTS

| | | | |
|---|---|---|---|
| 3,303,738 | A | 2/1967 | Clay et al. |
| 3,338,033 | A | 8/1967 | Ross |
| 3,400,026 | A | 9/1968 | Fearnow |

(List continued on next page.)

FOREIGN PATENT DOCUMENTS

| | | |
|---|---|---|
| CA | 2136572 | 5/1995 |
| EP | 0 194 775 | 5/1989 |
| EP | 131355 | 3/1990 |

*Primary Examiner*—Michael J. Carone
*Assistant Examiner*—Aileen J. Baker
(74) *Attorney, Agent, or Firm*—John C. McMahon

(57) ABSTRACT

The process for sensitizing in situ aqueous explosives before charging the mine holes comprises the formation of an emulsion of dispersion gas-in-liquid from a low sensitivity or non explosive matrix product which consists of a liquid mixture in solution, emulsion or suspension of oxidant in fuel, and a gas. The density of the final explosive product can be varied as a function of the gas flow rate and can be controlled before introducing it into the hole. The installation comprises a tank (1) with the matrix product, a gas reserve (10), a mixture (5), a pump (3), and a gas flow rate regulating device (8) and optionally a tank (2) with a gas bubble stabilizing agent, a dosing pump (4) and a flow meter (7).

22 Claims, 2 Drawing Sheets

U.S. PATENT DOCUMENTS 3,582,411 A 6/1971 Brockbank et al.
3,610,088 A 10/1971 Christensen et al.
3,678,140 A 7/1972 Adams et al.
3,706,607 A 12/1972 Chrisp
3,711,345 A 1/1973 Tomic
3,713,919 A 1/1973 Tomic
3,770,522 A 11/1973 Tomic
3,790,415 A 2/1974 Tomic
3,886,010 A 5/1975 Thornley et al.
4,003,429 A * 1/1977 Hay et al. ..... 166/51
4,008,108 A 2/1977 Chrisp
4,287,010 A 9/1981 Owen, II
4,526,633 A 7/1985 Lawrence
4,555,278 A 11/1985 Cescon et al.
4,685,375 A * 8/1987 Ross et al. ..... 86/20.15
4,911,770 A 3/1990 Oliver et al.
4,966,077 A * 10/1990 Halliday et al. ..... 102/313
4,986,858 A 1/1991 Oliver et al.
RE33,788 E * 1/1992 Clay ..... 149/1
5,099,763 A * 3/1992 Coursen et al. ..... 102/313
5,160,387 A * 11/1992 Sujansky ..... 149/2
5,244,475 A * 9/1993 Lownds et al. ..... 44/271
5,458,707 A * 10/1995 Delagey et al. ..... 149/60
5,500,062 A * 3/1996 Chattopadhyay ..... 149/46
6,125,761 A * 10/2000 Smith, Jr. et al. ..... 102/313

* cited by examiner

PROCESS AND MECHANISM FOR IN SITU SENSITIZATION OF AQUEOUS EXPLOSIVES

FIELD OF THE INVENTION

The present invention relates to a procedure and an installation for "in situ" sensitization of water based explosives by means of the incorporation of air or gas in a non explosive or low sensitivity mixture of oxidants and fuels with the formation of an emulsion or dispersion of gas in liquid.

BACKGROUND OF THE INVENTION

The mechanism of initiation of explosives by means of the generation of hot points due to the adiabatic compression of gas bubbles is the base of the modern industrial explosives formulated without components intrinsically explosive.

The introduction of gas bubbles can be made by the trapping during the mixture or by its formation through a chemical reaction. In the U.S. Pat. No. 3,400,026 a formulation which uses protein in solution (albumin, collagen, soy protein, etc.) in order to favour the formation of bubbles and their stabilization is described. The U.S. Pat. No. 3,582,411 describes a watergel explosive formulation which contains a foaming agent of the guar gum type modified by hydroxy groups.

In the U.S. Pat. No. 3,678,140 a process for the incorporation of air by means of the use of protein solution is described, passing the composition through a series of openings at pressures from 40 to 160 psi and simultaneously introducing air through eductors.

The gas bubbles incorporation by means of its generation as a result of a chemical reaction is described in the U.S. Pat. Nos. 3,706,607, 3,711,345, 3,713,919, 3,770,522, 3,790,415 and 3,886,010.

In relation to the manufacturing of the explosive in situ, that is, in the same truck used for the pumping of the explosive to the bores, the first patents are due to IRECO, such as it is described in the U.S. Pat. Nos. 3,303,738 and 3,338,033. These patents are characterized by the manufacturing in the truck of a watergel explosive by means of the dosification and mixture of oxidant salts liquid solution with a solid material which contains oxidant salts and thickeners. In U.S. Pat. No. 3,610,088 (IRECO) the same procedure of the previous patents are used for the formation of the watergel in situ and incorporate the simultaneous addition of air either by means of mechanical trapping or its generation through a chemical reaction. The EP patent 0 203 230 (IRECO) describes a mixer form by mobile and fixed blades which allows the manufacturing in situ of a blasting agent of water in oil emulsion type. The sensitizing of this emulsion is carried out by the addition of low density particles (oxidant or hollow microspheres).

The manufacturing of the explosive in situ has as main advantage the decreasing of the risk during the transport. In contrast it cannot be guaranteed the same levels of quality in the products as in the case of being manufactured in a manufacturing plant.

Another alternative is the transport of the finished product without sufficiently sensitizing, that is, at a density such that it has no capacity of propagating an stable detonation. In this context it has been generalized in the last years the transport of the base product and its sensitizing in mine either by mixing it with particulated nitrates of low density or mixtures of ammonium nitrates with hydrocarbons (ANFO) or through the generation of bubbles by means of a chemical reaction. The U.S. Pat. No. 4,555,278 describes an explosive of this type manufactured by mixing emulsion and ANFO. The European patent EP 0 194 775 describes an explosive of the type previously mentioned, formed starting from a base watergel.

The sensitizing of the base emulsion by generating bubbles of gas through chemical reaction is the widest used method at present. However in order to avoid the coalescence of the gas bubbles, such as it is described in the U.S. Pat. No. 4,008,108, the pumping and the handling of the emulsion should be carried out before the gasification reaction takes place. In this way, this method has the great disadvantage of having to wait a certain time from the filling of the holes until the final density is achieved, not having capacity of manoeuvre if the obtained density does not coincide with the expected one, being able to produce sensitizing failures or an incorrect distribution of the explosive in the bore hole column.

DETAILED DESCRIPTION OF THE INVENTION

Figure 1:
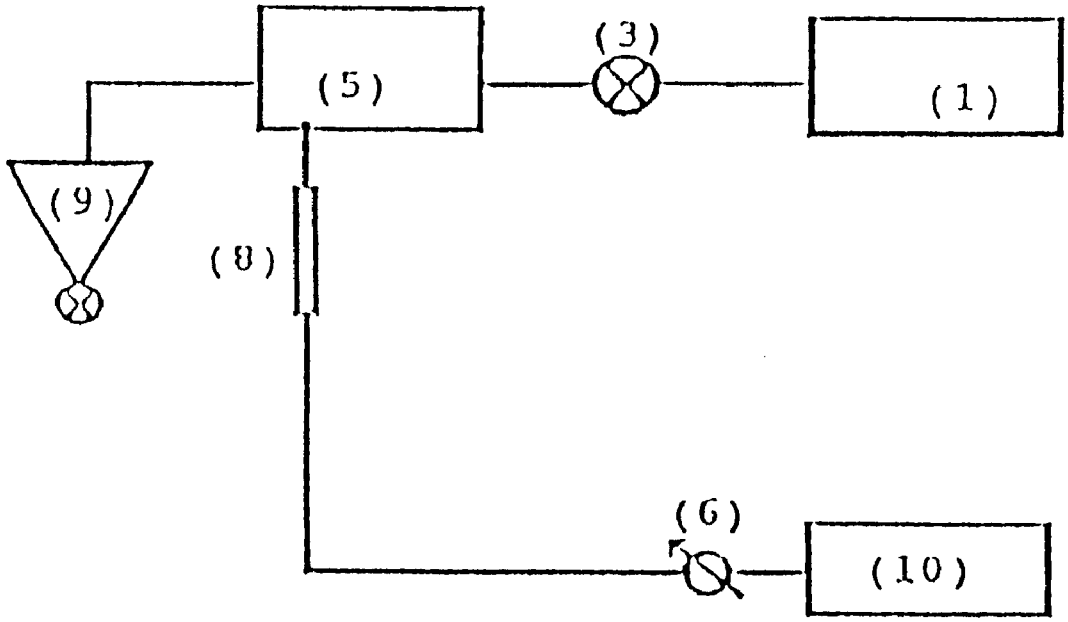
FIG. 1 shows a schematic drawing of a particular embodiment of an installation for "in situ" sensitization of water based explosive according to this invention.

The invention provides a procedure for "in situ" sensitization of water based explosive, which comprises:

a) the transport of a non explosive or low sensitivity base product composed by an aqueous base liquid mixture which comprises oxidants and fuels, in solution, in emulsion or in suspension, optionally together with exceptionally sensitizing and thickening agents; and b) the dosification and delivery of said base product and of a gas towards a mixer where the explosive is mixed and sensitized by the formation of an emulsion or dispersion of gas in liquid, adjusting its density by the regulation of the gas flow.

Optionally, the procedure may include the addition of a solution for the stabilization of the gas bubbles.

In this description "in situ sensitization" means the sensitization of the explosive before the loading of the holes.

The base product is formed by a water based liquid mixture that comprises oxidants and fuels in solution, in emulsion or in suspension, and optionally, sensitizing and thickening agents.

As oxidant salts, nitrates, chlorates and perchlorates of ammonium, alkaline and alkaline-earth metals may be used as well as mixtures thereof. Precisely, these salts can be among others, the nitrates, chlorates, and perchlorates of ammonium, sodium, potassium, lithium, magnesium, calcium, or mixtures thereof. The total concentration of oxidant salts present in the base product may vary between 30% and 90% by weight of the formulation, preferably between 40 and 75%.

Organic compounds belonging to the group formed by aromatic hydrocarbons, saturated or unsaturated aliphatic hydrocarbons, oils, petrol derivatives, vegetable occurring derivatives such as starches, flours, sawdust, molasses and sugars, or metallic fuels finely divided such as aluminum or ferro-silica may be used as fuels. In general, the total fuel concentration in the base product may vary between 1% and 20% by weight of the formulation, preferably between 3% and 7%.

The alkylamine nitrates, alkanolamine nitrates, and mixtures thereof, such as methylamine nitrate, ethanolamine nitrate, diethanolamine nitrate, triethanolamine nitrate, dimethyl-amine nitrate, as well as the nitrates from other hydrosoluble amines such as hexamine, diethylenetriamine, ethylenediamine, laurylamine and mixtures thereof, may be used as sensitizing agents. The total concentration of sensitizing agents in the base product (if present) may vary between 0.5% and 40% by weight of the formulation, preferably between 2% and 30%.

As thickening agents, products derived from seeds such as guar gum, galactomananes, biosynthetic products such as xanthane gum, starch, cellulose and their derivatives such as carboxymethylcellulose or synthetic polymers such as polyacrylamide, may be used. The concentration of thickening agents in the base product (if present) may vary between 0.1% and 5% by weight of the formulation, preferably between 0.5% and 2%.

The formation of the emulsion or gas dispersion in the base product is carried out in an inline mixer preferably of the dynamic type such as a stirrer. The base product, the gas and optionally the bubbles stabilizing agent are sent to the mixer through their respective doser. In a preferred embodiment, the feeding of the components is carried out through the bottom of the mixer, with the product coming out spilling over by the upper part.

As gases it may be employed those commonly used for the sensitizing of the explosives such as nitrogen, oxygen, air or carbon dioxide. The volumetric ratio between the gas and the base product may vary between 0.05 and 5, preferably between 0.1 and 1.

Additionally, stabilizing agents of the gas bubbles can be added, among which there are surface-active agents solutions or dispersions of the type derived from amines of fatty acids such as for example laurylamine acetate or proteins of the type egg albumin, lactalbumin, collagen, soy protein, guar protein or modified guar gum of the guar hydroxypropyl type. The stabilizing agent may be added to the base product in a concentration comprised between 0.01% and 5% by weight of the formulation, preferably between 0.1% and 2%.

By means of this procedure an explosive may be manufactured with a suitable density before charging it into the hole, in this way allowing to control the quality of the explosive which is being charged.

Once the explosive is sensitized this can be either directly delivered to the bore holes or it may be added to it a crosslinking agent to improve its water resistance. Among the crosslinking agents the antimmonium compounds such as potassium pyroantimoniate, antimmonium and potassium tartrate, chromium compounds such as chromic acid, sodium or potassium dichromat, zirconium compounds such as zirconium sulphate or zirconium diisopropylamine lactate, titanium compounds such as titanium triethanolamine chelate or aluminum compounds such as aluminum sulphate, can be used. The concentration of the crosslinking agent may vary between 0.01% and 5% by weight of the formulation, preferably between 0.01% and 2%.

In an specific and preferred embodiment, the procedure for "in situ" sensitization of water based explosives provided for this invention is carried out in a truck for loading the holes which has available a tank containing the base product, a doser pump of the base product and a device for the dosification of gas to the base product in the mixer.

The procedure for "in situ" sensitization of water based explosives provided by this invention has the advantage of allowing the instant change of the density of the explosive, as well as the size of the air bubbles through the adjustment of the energy applied in the mixer. In this way for a final density value of the explosive, it can be acted upon its sensibility and speed of detonation. Additionally, with the procedure of the invention it can only be manufactured the explosive which must be charged in the hole. The high precision of the method allows to vary the explosive density either between different holes or in the same hole.

Optionally the addition of particulated oxidants or ANFO type explosives, that is a mixture of an particulated oxidant and a hydrocarbon, is contemplated.

The invention also relates to an installation for "in situ" sensitization of water based explosives according to the previously described procedure, as the one shown in FIG. 1, which comprises:

a tank (1) for the storage of the base product;

a gas reserve (10)

a mixer (5)

a pump (3) which connects the tank (1) of the base product to the mixer; and a regulating device of the gas flow or flowmeter (8).

The mixer (5) can operate continuously and may be of the dynamic type such as for example a stirrer or a static mixer. At the outlet of the mixer (5) a pump provided with hopper(9) can be installed which is used for charging the explosive already sensitized in the holes.

Figure 2:
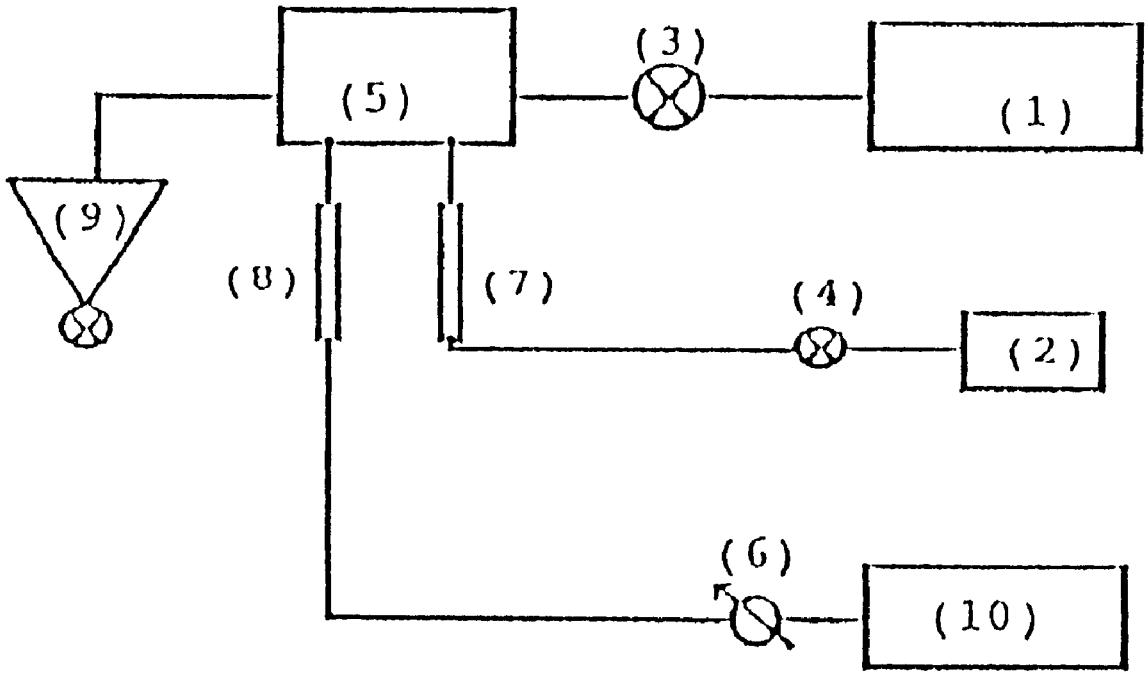
FIG. 2 shows a schematic drawing of another particular embodiment of an installation for "in situ" sensitization of water based explosive according to this invention which includes a stabilizing tank, a doser and a flowmeter.

FIG. 2 shows an alternative embodiment of the installation provided by this invention which is suitable for carrying out the procedure in which the stabilizing is added to the mixture of the base product and the gas in the mixer. This alternative installation comprises, besides the equipments previously mentioned, a tank (2) for storing the stabilizing solution of the gas bubbles, a doser pump (4) and a flowmeter (7).

In a particular and preferred embodiment, the installation is located on a truck for loading the holes or a pumping truck, which has available a tank that contains the base product, a loading pump and a device in order to dose the gas to the base product.

The invention is illustrated by means of the following example which in any case limits the scope of the invention.

EXAMPLE

In this example a typical installation and the explosive manufactured thereof, is described.

This installation is located on a truck which allows the transport of the base mixture and its sensitizing in the mine. It has the following elements (FIG. 2):

a tank (1) of 10,000 l where the base mixture is stored;

a tank (2) of 200 l for the storing of the stabilizer;

two pumps (3 and 4) for the transfer of the base mixture and the stabilizer to a mixer (5) of stirrer type;

a valve (6) connected to an air line, for the dosification of air to the mixer (5);

two flowmeters (7 and 8) interpolated among the pump (4), the valve (6) and the mixer (5) for the control of the respectively stabilizing and air flows; and a pump provided of a hooper (9) located at the outlet of the mixer (5) used to load the explosive already sensitized in the holes.

The tank (1) was filled with the base formulation described in Table 1.

TABLE 1

Composition of the base product

| Component | % |
|---|---|
| Water | 11.5 |
| Ammonium Nitrate | 75.6 |
| Monomethylamine Nitrate | 9.2 |
| Guar Gum | 0.6 |
| Mineral oil | 3.1 |

The density of this base product before its sensitizing in the previously described device was 1.49 g/cm$^3$. In the tank (2) a solution of a stabilizer composed by 90 parts of water and 10 parts of powdered milk serum with a protein content of 30%, was prepared.

After the dosers have been calibrated, the operation started connecting the stirrer and the different pumps in the conditions described in Table 2.

TABLE 2

Operating conditions and properties of the obtained explosive

| Mixer r.p.m. | Base Material kg/min | Stabilizer kg/min | Air l/min | Density g/cm$^3$ | VOD m/s |
|---|---|---|---|---|---|
| 520 | 150 | 0.5 | 23 | 1.21 | 3850 |
| 750 | 150 | 1 | 35 | 1.11 | 4050 |
| 1,300 | 200 | 1.5 | 40 | 1.15 | 4500 |
| 1,000 | 100 | 1 | 35 | 0.98 | 4400 |
| 1,200 | 80 | 1 | 50 | 0.77 | 3200 |

The explosive already sensitized came out spilling over the mixer (5) falling over the hopper (9) from which it was pumped to the holes injecting in the hose a crosslinking solution of 6% chromic acid in water.

The VOD values correspond to samples tested in iron pipes of 50 mm of inner diameter and primed with a 15 g pentrite (PETN) booster.

What is claimed is:

1. A procedure for "in situ" sensitization of water based explosives utilizing a mobile apparatus, the procedure including the steps of (I) transporting a base product to a loading place for explosives receiving boreholes wherein said base product is selected from a group consisting of non-explosive, low sensitivity materials and mixtures thereof and further wherein said base product includes an aqueous liquid mixture, said mixture selected from a group consisting of oxidants and fuels in solution, oxidants and fuels in emulsion, oxidants and fuels in suspension and mixtures thereof and (ii) the sensitization of said base product before the loading of said base product in the boreholes; said procedure further including the steps of:

performing such sensitization for each production of said explosives by mixing said base product with a gas stream in a mixer, so as to form a controllable and variable but stable concentration of the gas in said base product in situ; and mixing said base product and gas with said mixer while adjusting the density of the sensitized explosive by the regulation of flow of the gas stream and adjusting gas bubble size by varying energy applied by said mixer to said base product and gas so as to vary the density of the final explosive and to produce a stable final explosive having a preselected density when the explosive exits the mixer.

2. A procedure according to claim 1, including the step of adjusting said base product to contain between 30% and 90% by weight of oxidants.

3. A procedure according to claim 1, including the step of adjusting said base product to contain an oxidant selected from the group consisting of nitrates, chlorates and perchlorates of ammonium, alkaline metals, alkaline-earth metals and mixtures thereof.

4. A procedure according to claim 1, including the step of adjusting said base product to contain between 1% and 20% by weight of fuels.

5. A procedure according to claim 1 including the step of adjusting said base product to contain a fuel selected from the group consisting of aromatic hydrocarbons, aliphatic hydrocarbons, oils, petrol derivatives, vegetable occurring derivatives, finely divided metallic fuels, and mixtures thereof.

6. A procedure according to claim 1, including the step of selecting said gas from the group consisting of air, nitrogen, oxygen, carbon dioxide and mixtures thereof.

7. A procedure according to claim 1 including the step of adjusting a volumetric ratio between the gas and the base product ranges between 0.05 and 5.

8. A procedure according to claim 1 including the step of adding a stabilizing solution for stabilizing gas bubbles.

9. A procedure according to claim 8 including the step of selecting said stabilizing solution [of the gas bubbles is selected] from the group consisting of surface-active solutions and dispersions of amines of fatty acids, proteins, modified guar gum and mixtures thereof.

10. A procedure according to claim 1 including the step of adding to said mixture an agent selected from the group consisting of sensitizing agents, thickening agents and mixtures thereof.

11. A procedure according to claim 10 including the steps of adjusting said base product to contain between 1.5% and 40% by weight of sensitizing agents.

12. A procedure according to claim 10 including the steps of adjusting said base product to contain sensitizing agent selected from the group consisting of alkylamine nitrates, alkanolamine nitrates and mixtures thereof.

13. A procedure according to claim 10 including the step of adjusting said base product to contain between 0.1% and 5% by weight of thickening agents.

14. A procedure according to claim 10 including the step of adjusting said base product to contain a thickening agent selected from the group consisting of products derived from seeds, biosynthetic products and biosynthetic product derivatives, synthetic polymers and mixtures thereof.

15. A procedure according to claim 1 including the step of adding a gas bubble stabilizing solution to the mixer.

16. A procedure according to claim 15 including the step of adjusting the energy applied by the mixer to vary the resulting density of the explosive.

17. A procedure according to claim 1 including the step of applying dynamic mixing to said base product and gas in said mixer.

18. A procedure according to claim 1 including the step of varying the volume of the gas stream entering the mixer so as to adjust the density of the resulting combination of the gas and base product, so as to allow the density of the resulting explosive to be varied with each borehole.

19. A mobile loading truck, said truck being useful for "in situ" sensitization of water based explosives having a final composition having a selectable variable density and that is stable, said truck comprising:

a mixer;

a tank for the storage of the base product;

a pump flow connecting said tank for the storage of the base product to the mixer;

said mixer being adjustable for allowing an operator to vary energy placed into an explosive composition during mixing in said mixer;

a gaseous reserve of gas operatively connected to the mixer; and a gas flow regulating device said regulatory device operably controlling flow of gas from said gaseous reserve into said explosive composition in said mixer and cooperating with the energy placed into said composition by said mixer no as to adjust a final density of the composition and so as to produce the final explosive with a stable density upon exiting said mixer.

20. A loading truck according to claim 19 further including a tank for the storage of a gas bubble stabilizing solution and a doser pump.

21. A loading truck according to claim 20 wherein said mixer is a dynamic type mixer.

22. A loading truck according to claim 19 wherein said mixer operates continuously.

* * * * *